US009840795B2

(12) United States Patent
Schweizer

(10) Patent No.: US 9,840,795 B2
(45) Date of Patent: Dec. 12, 2017

(54) DEVICE AND METHOD FOR ACQUIRING AND PROCESSING MEASUREMENT QUANTITIES IN A SEWING MACHINE

(71) Applicant: BERNINA International AG, Steckborn (CH)

(72) Inventor: Manfred Schweizer, Steckborn (CH)

(73) Assignee: BERNINA International AG, Steckborn (CH)

( * ) Notice: Subject to any disclaimer, the term of this patent is extended or adjusted under 35 U.S.C. 154(b) by 33 days.

(21) Appl. No.: 14/887,795

(22) Filed: Oct. 20, 2015

(65) Prior Publication Data

US 2016/0138205 A1 May 19, 2016

Related U.S. Application Data

(63) Continuation of application No. 11/079,068, filed on Mar. 14, 2005, now abandoned.

(30) Foreign Application Priority Data

May 28, 2004 (CH) ..... 0909/04

(51) Int. Cl.

| | |
|---|---|
| ***G06F 7/66*** | (2006.01) |
| ***D05B 19/08*** | (2006.01) |
| ***D05B 19/02*** | (2006.01) |
| ***D05B 69/36*** | (2006.01) |
| ***D05B 19/12*** | (2006.01) |
| *D05B 29/00* | (2006.01) |
| *D05B 51/00* | (2006.01) |
| *D05B 55/00* | (2006.01) |
| *D05B 57/26* | (2006.01) |
| *D05B 59/02* | (2006.01) |
| *D05B 73/12* | (2006.01) |
| *D05B 87/00* | (2006.01) |

(52) U.S. Cl.

CPC ..... *D05B 19/08* (2013.01); *D05B 19/02* (2013.01); *D05B 19/12* (2013.01); *D05B 69/36* (2013.01); *D05B 29/00* (2013.01); *D05B 51/00* (2013.01); *D05B 55/00* (2013.01); *D05B 57/26* (2013.01); *D05B 59/02* (2013.01); *D05B 73/12* (2013.01); *D05B 87/00* (2013.01); *D05D 2205/14* (2013.01)

(58) Field of Classification Search

CPC .... D05B 19/02; D05B 19/04; D05B 19/0612; D05B 59/02

USPC ..... 700/136–137

See application file for complete search history.

(56) References Cited

U.S. PATENT DOCUMENTS

| | | | |
|---|---|---|---|
| 4,178,866 | A | 12/1979 | Adams |
| 4,481,507 | A | 11/1984 | Takiguchi et al. |

(Continued)

FOREIGN PATENT DOCUMENTS

| | | |
|---|---|---|
| DE | 198 50 742 | 5/2001 |
| DE | 202 00 879 | 7/2002 |

*Primary Examiner* — Nathan Durham

(74) *Attorney, Agent, or Firm* — Volpe and Koenig, P.C.

(57) ABSTRACT

A method and the device for acquiring and processing measurement quantities in a sewing machine (1) using at least one camera (25), situated on a sewing machine (1), for the acquisition and processing of image data for sewing machine elements and sewing elements. An image processing unit connected downstream from the camera (25) processes the images supplied by the camera (25), taking into account data stored in a target quantity memory, and influences the behavior of the machine control unit dependent on the result of the processing.

20 Claims, 6 Drawing Sheets

(56) References Cited

U.S. PATENT DOCUMENTS

| | | | |
|---|---|---|---|
| 4,548,143 | A | 10/1985 | Martell et al. |
| 4,602,577 | A | 7/1986 | Kothe et al. |
| 4,784,071 | A | 11/1988 | Sadeh et al. |
| 4,798,152 | A | 1/1989 | Simons et al. |
| 4,805,544 | A | 2/1989 | Dobner et al. |
| 4,834,008 | A | 5/1989 | Sadeh et al. |
| 5,095,835 | A | 3/1992 | Jernigan et al. |
| 5,271,345 | A | 12/1993 | Matschulat et al. |
| 5,353,726 | A | 10/1994 | Bruder et al. |
| 5,780,687 | A | 7/1998 | Holderich et al. |
| 5,899,157 | A | 5/1999 | Kurono et al. |
| 6,138,594 | A | 10/2000 | Kito |
| 6,158,366 | A | 12/2000 | Codos |
| 6,263,815 | B1 | 7/2001 | Furudate |
| 6,959,657 | B1 | 11/2005 | Duval |
| 2002/0124781 | A1 | 9/2002 | Migliorini |
| 2002/0131773 | A1 | 9/2002 | Bigler |
| 2003/0201328 | A1 | 10/2003 | Jam et al. |
| 2004/0040482 | A1 | 3/2004 | Fluckiger |
| 2005/0016428 | A1 | 1/2005 | Koerner |

DEVICE AND METHOD FOR ACQUIRING AND PROCESSING MEASUREMENT QUANTITIES IN A SEWING MACHINE

INCORPORATION BY REFERENCE

The following documents are incorporated herein by reference as if fully set forth: U.S. application Ser. No. 11/079,068, filed Mar. 14, 2005; and Swiss Patent Application No. 00909/04, filed May 28, 2004.

BACKGROUND

The subject matter of the present invention is a device and a method for acquiring and processing measurement quantities in a sewing machine.

It is known that in sewing machines a camera can be provided that monitors the article being sewn during the sewing process. In this way, differences in quality that may be caused by different transport characteristics of different types of sewn articles can be acquired.

As is disclosed for example in DE 19850742, the camera can be used to determine the position of two adjacent stitch points of the sewing needle on the article being sewn. A comparator device determines deviations of the actual values from stored target values for the position of these stitch points, and influences the advance of the material in such a way that subsequent stitch points deviate as little as possible from the desired target positions.

Although the characteristics of the article being sewn, which can vary greatly, in interaction with the device for transporting the article being sewn are not the only factors responsible for the problem-free functioning of a sewing machine, up until now a camera has been used only to monitor the article being sewn.

SUMMARY

Therefore, the object of the present invention is to create a device and a method for using a camera to acquire and process measurement quantities in a sewing machine that ensure problem-free operation of the sewing machine.

This objective is achieved by a device and a method for acquiring and processing measurement quantities in a sewing machine. With the method according to the present invention and the device according to the present invention, sewing machine elements and their disposition on the sewing machine can be monitored. Thus, for example, items of information concerning the type of particular sewing machine elements and their correct disposition on the sewing machine can be acquired. The acquisition and evaluation take place using one or more cameras connected to an image processing unit. According to the position of the camera, or of an imaging optical system allocated to the camera, imaging information on sewing machine elements can be acquired from the inside of the lower arm (e.g., spool, spool capsule, or throat plate) or from above the throat plate (e.g., sewing needle, sewing foot, throat plate, hoop). The cameras and/or the imaging optical systems, or parts thereof, can be situated so as to be capable of movement. They can for example be mounted so as to be capable of pivoting about one or more pivot axes, and/or so as to be capable of movement along an axis of translation. Changes of position can be brought about for example using step motors or other drive means that can be controlled by the sewing machine control unit. The image information is evaluated by an image processing unit. The image processing unit can use features, or comparison or target quantities, that are stored in a target quantity memory. In a preferred construction of the present invention, the image processing unit can in addition also store information or target quantities in the target quantity memory. Such target quantities can for example include color or character codes, or information concerning shape, contour, structure, or position of a sewing machine element.

The image processing unit can be functionally connected with the sewing machine control unit or can be a component thereof. The image processing unit can check for the presence and/or the correct mounting of one or more sewing machine elements and/or their spatial position on the sewing machine. Various functions of the sewing machine control unit that use the information from the image processing unit can contribute to the automation, simplification, or improvement of operating, monitoring, and control tasks, the issuance of warnings when errors occur or the execution of certain subsequent operations, the prevention of accidents, or the ensuring or improvement of the quality of the sewing process.

In addition to the acquisition and evaluation of information concerning sewing machine elements that are components or accessories of the sewing machine, the image processing unit can also be fashioned for the acquisition and evaluation of information concerning sewing elements. The category of sewing elements includes the article being sewn and the threads used for the processing of the article being sewn before and after the processing. The information concerning sewing elements can also be used by the sewing machine control unit in particular for the controlling or regulation of sewing processes, for example for influencing the longitudinal and/or transverse movement of a material transport device.

The camera can also be used to determine criteria of comparison for the target quantity memory. Alternatively, or in addition, such features or target quantities can also be read into the target quantity memory via an interface.

BRIEF DESCRIPTION OF THE DRAWINGS

The present invention is explained in more detail in the following with reference to the drawing Figures.

DETAILED DESCRIPTION OF THE PREFERRED EMBODIMENTS

Figure 1:
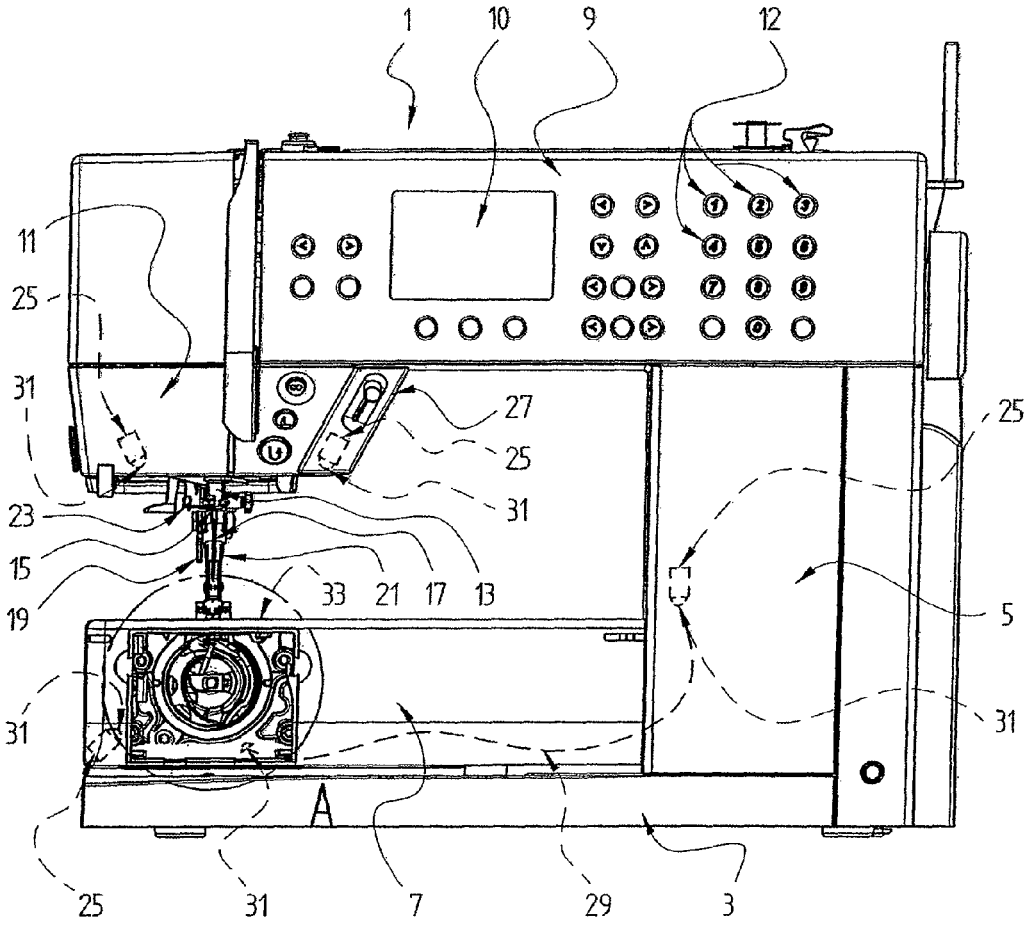
FIG. 1 shows a sewing machine in a side view.
Figure 1A:
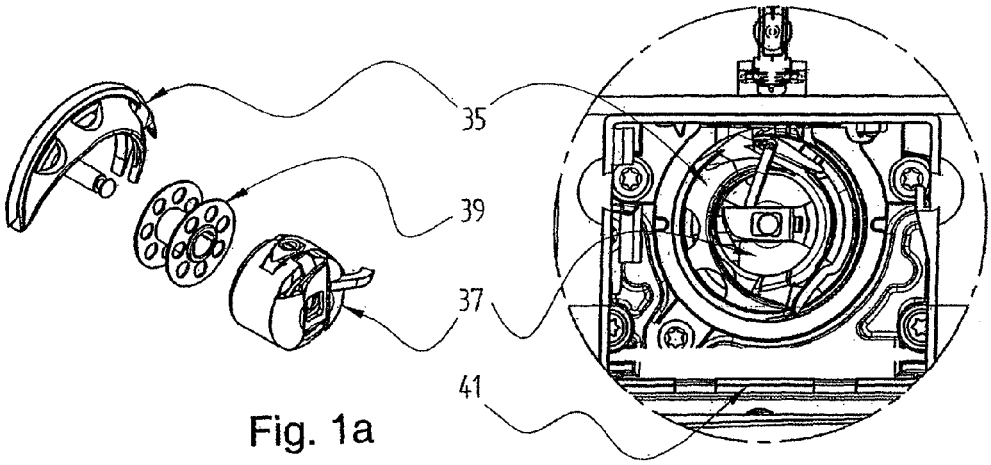
FIG. 1A is a detail view taken from FIG. 1 in the indicated area A in the area of the shuttle in an enlarged, partially exploded view.

FIGS. 1 and 1A schematically show a sewing machine 1 having a base 3, a pedestal 5 that is fastened to and supported on base 3, and a free or lower arm 7 fastened thereto, as well as upper arm 9. A display unit 10, or a display screen and operating elements 12, are situated laterally on the upper arm 9. The front end of upper arm 9 is formed as a sewing machine head 11. On the lower side of sewing machine head 11, extends a needle bar 13 having a needle holder 15, a sewing needle or needle 17 placed in needle holder 15, a sewing foot holder 19 having a sewing foot 21 placed therein, and a threading device 23. Two cameras 25, represented by broken lines, are integrated into the sewing machine head 11, or in an additional module 27 that is fastened laterally thereon and that can be removed, in such a way that they can acquire one or more of the sewing machine elements or parts thereof that are visible between the sewing machine head 11 and the lower arm 7. An additional camera 25, likewise represented by broken lines, is situated in the front area of the lower arm 7 in such a way that it can acquire sewing machine elements or parts thereof that are visible there. Alternatively, cameras 25 can also be situated in other areas of the sewing machine 1, for example in the area of the pedestal 5 or of the upper arm 9. In addition, optical elements, such as for example light waveguides 29, lenses 31, or mirrors for the formation of an acquisition area, can be placed on the camera 25. In this way, even unfavorably situated areas of acquisition can be imaged using a camera 25. Cameras 25 can thus be situated on the sewing machine 1 where there is available space for them, largely independent of their areas of acquisition. In this way, even sewing machine elements that are difficult to access can be acquired. In the simplest embodiment of the present invention, one camera 25 is sufficient. A plurality of cameras 25 can however also work together in such a way that objects such as sewing machine elements or sewing elements can be acquired from a variety of directions.

The designation "sewing machine elements" includes components and accessory parts that are situated fixedly on the sewing machine 1 as well as parts and accessories that can be detached from the sewing machine; for example, the needle bar 13, the needle holder 15, the needle 17, the sewing foot holder 19, the sewing foot 21, the threading device 23, a throat plate 33, a hook 35, a bobbin case 37 placed in the hook 35, or a bobbin 39 placed in the bobbin case 37 that is empty or is partially or completely equipped with thread. For better visibility of the sewing machine elements, in FIG. 1 a cover 41, situated on the front side of the lower arm 7, is opened. Additional possible sewing machine elements include detachable work supports, straightedges, additional apparatuses, or hoops (not shown).

Figure 2:
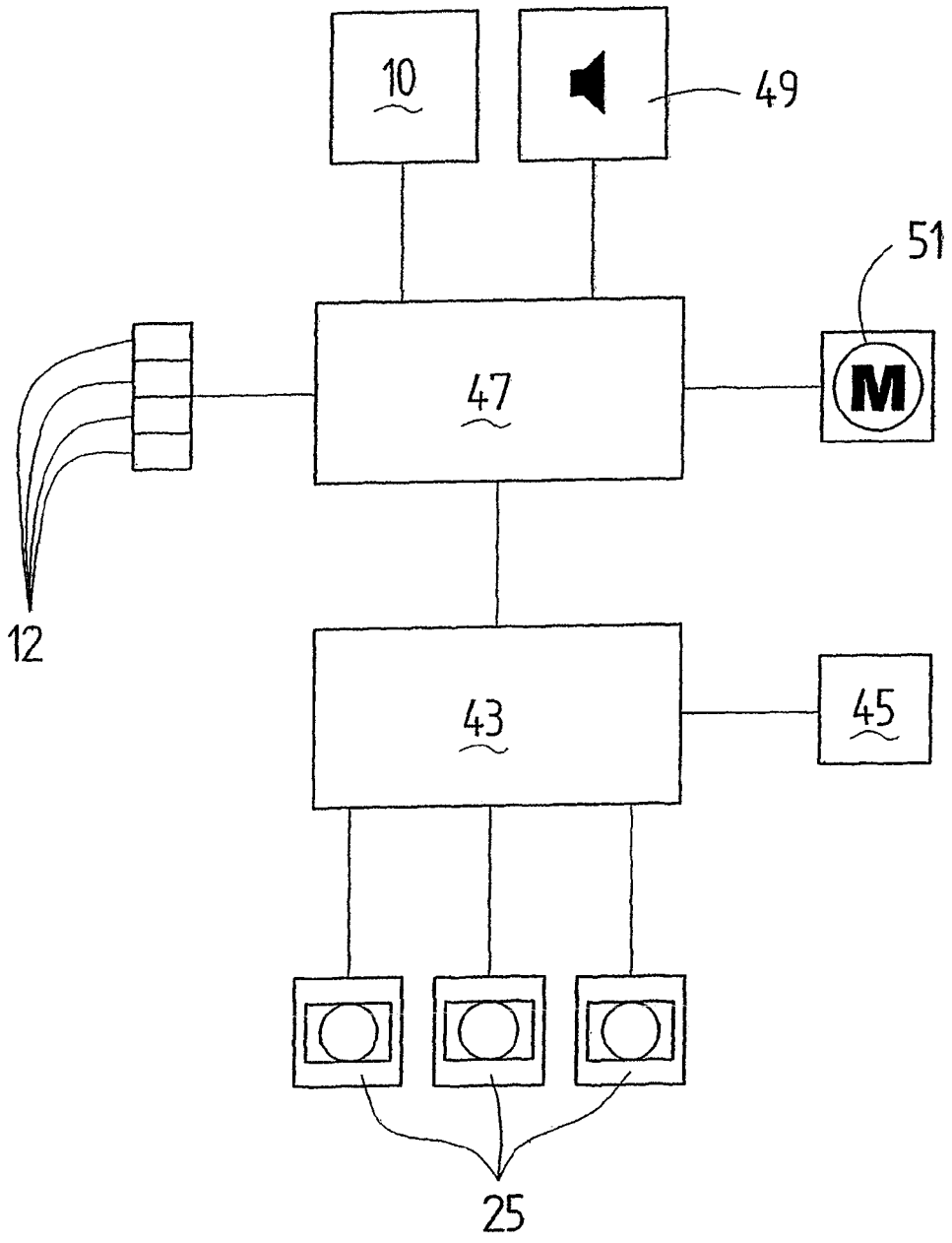
FIG. 2 shows a schematic diagram of a part of a sewing machine having an acquisition device.

FIG. 2 shows a schematic diagram of the design of the device for acquiring measurement quantities. The cameras 25 can for example comprise black-and-white or color CCD or CMOS image sensors having a one- or two-dimensional array of light-sensitive pixels. They are connected to an image processing unit 43 that processes the image information acquired by the cameras 25. Alternatively, a separate image processing unit 43 can be allocated to each of the cameras 25. This image processing unit can for example be completely or partially integrated on the same chip as the camera 25.

The image processing unit 43 is functionally connected to a target quantity memory 45, for example in a non-volatile flash memory. In addition, there is a functional connection between the image processing unit 43 and the sewing machine control unit (called machine control unit 47 for short). Of course, the image processing unit 43 can also be integrated completely or partially into the machine control unit 47. The machine control unit 47 comprises a plurality of interfaces, for example to operating elements 12, to the display unit 10, to an acoustic signal transducer 49, and to main drive 51, which, depending on the design of the sewing machine 1, is used for example to drive the needle bar 13 and the hook 35.

Figure 3A:
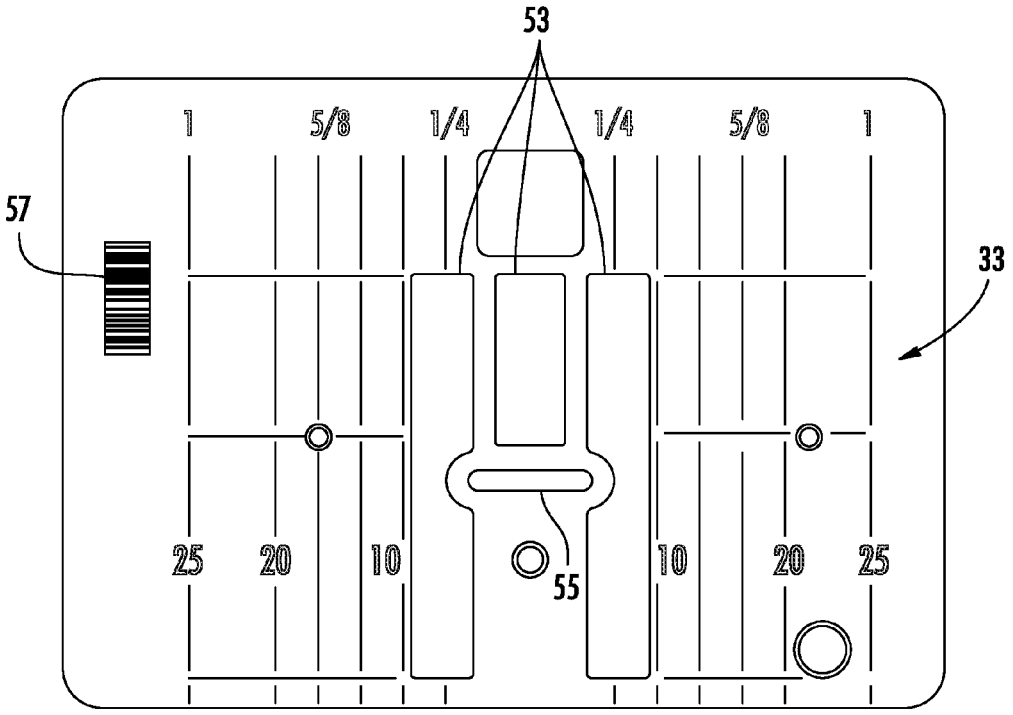
FIG. 3A is a view of a first throat plate.
Figure 3B:
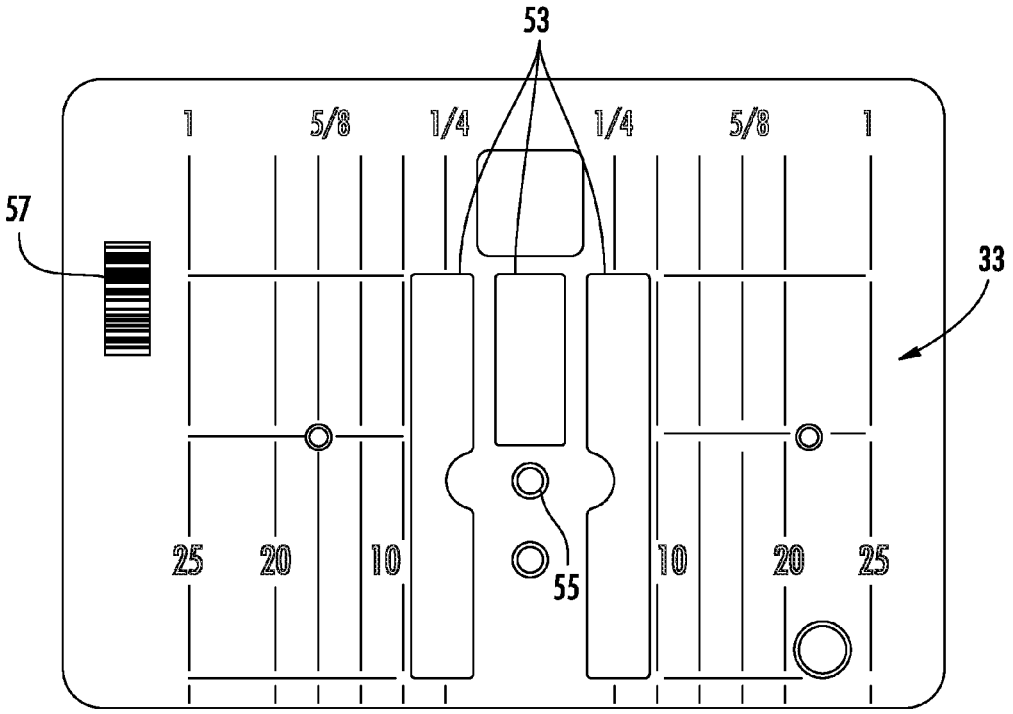
FIG. 3B is a view of a second throat plate.
Figure 4A:
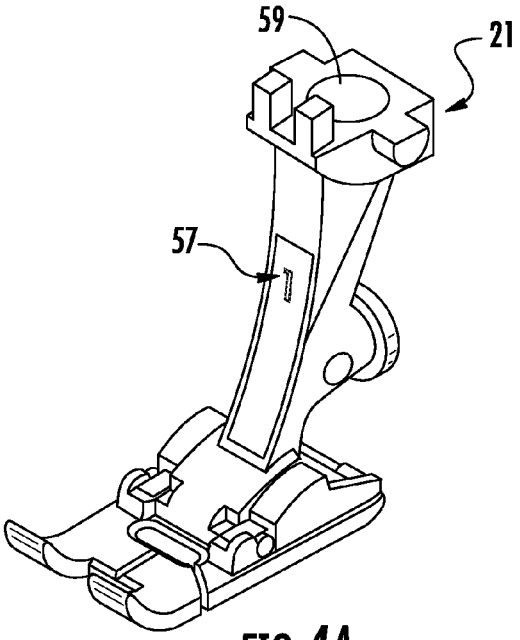
FIGS. 4A-4D are views of four different types of sewing feet.
Figure 4B:
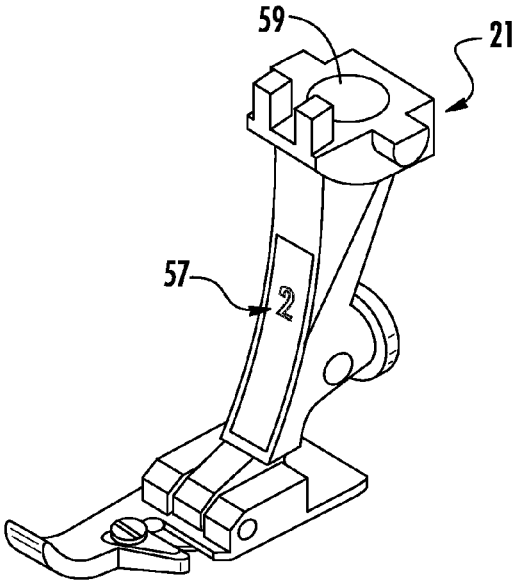
Figure 4C:
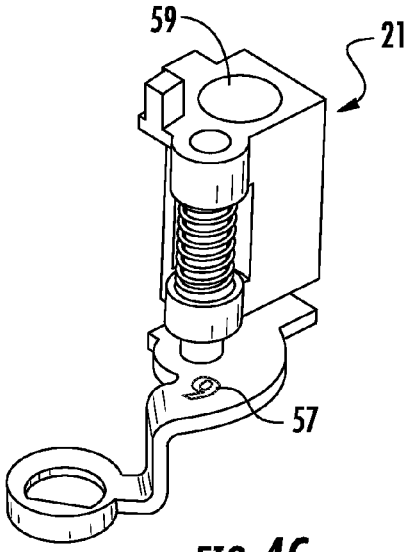
Figure 4D:
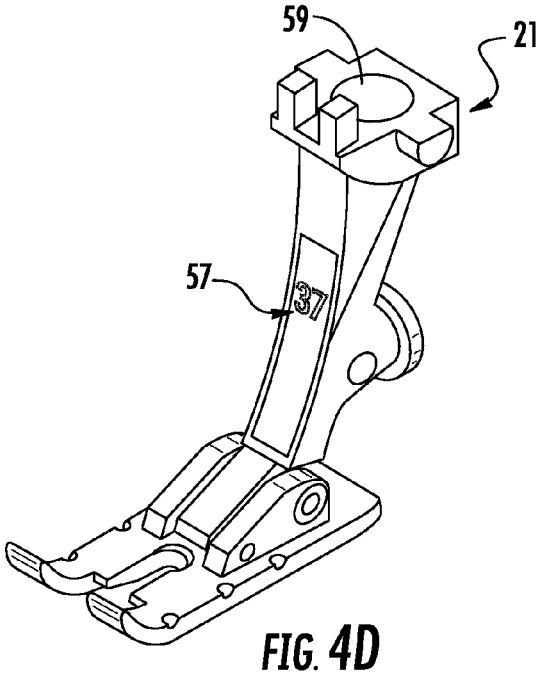
Figure 5A:
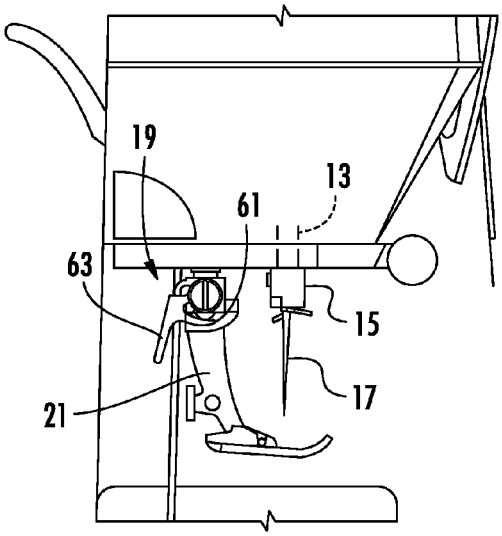
FIG. 5A shows a side view of a sewing machine with a correctly fastened sewing foot.
Figure 5B:
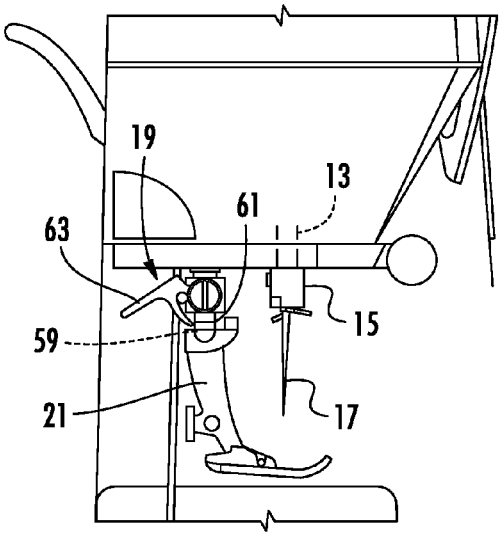
FIG. 5B shows a side view of a sewing machine with an incompletely fastened sewing foot.
Figure 5C:
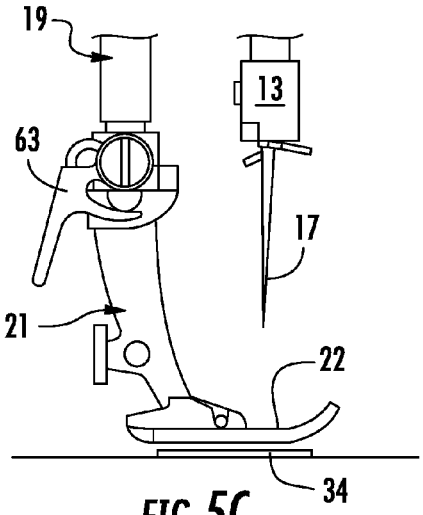
FIG. 5C shows a side view of a sewing machine in which the sewing foot lies flat.
Figure 5D:
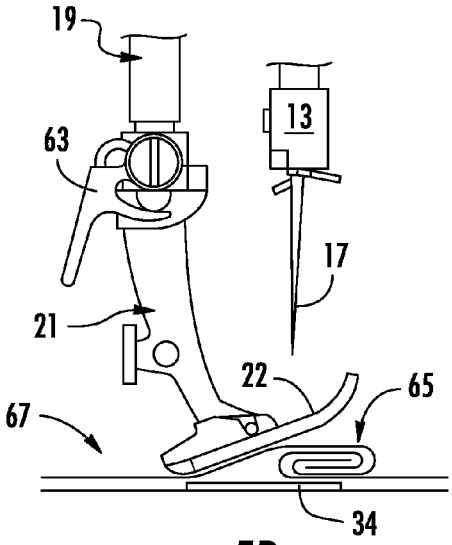
FIG. 5D shows a side view of a sewing machine in which the sewing foot lies obliquely.
Figures 6A, 6B, 6C, 6D, 6E, 6F, 6G, 6H, 6I:
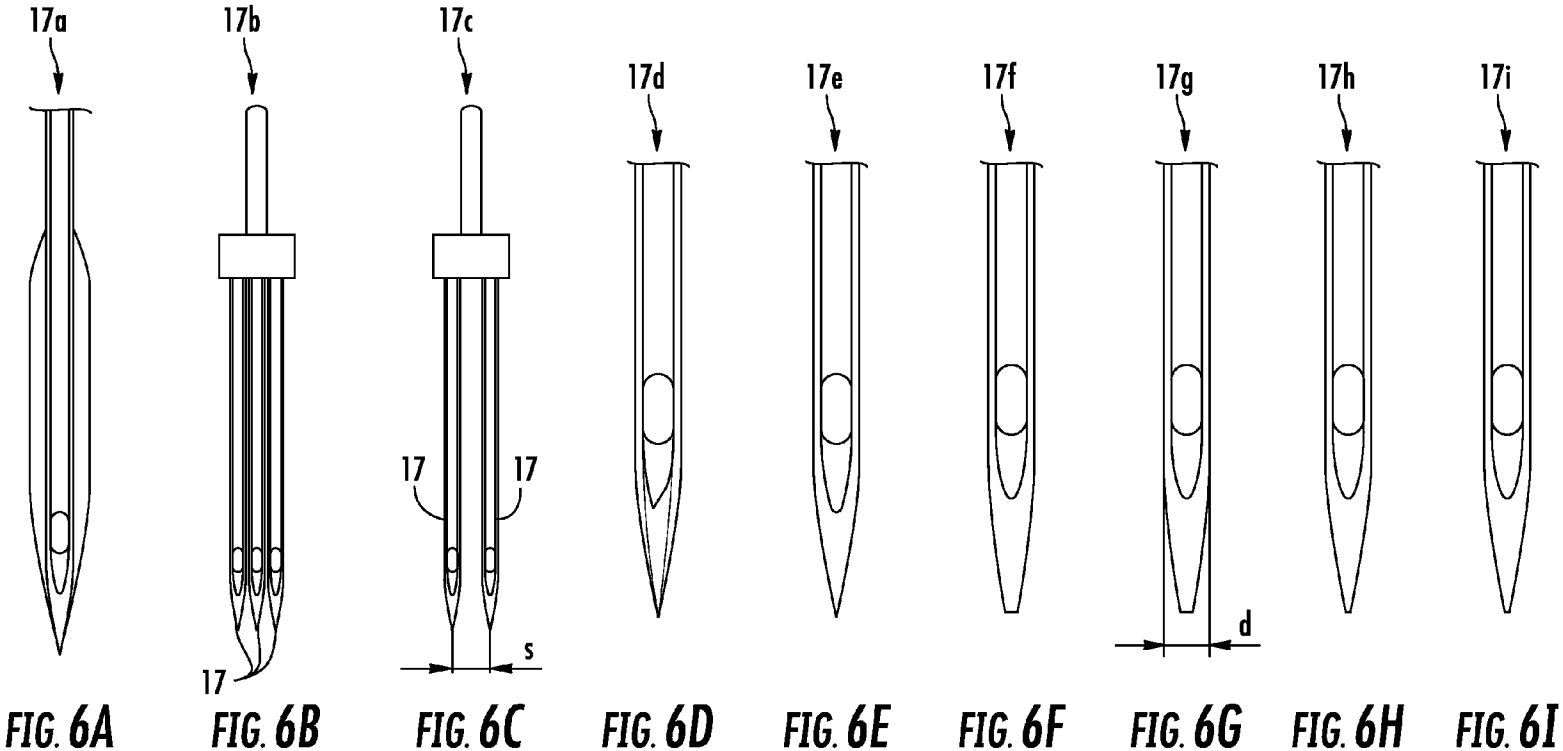
FIGS. 6A-6I are views of nine different sewing needle types.

In FIGS. 3A and 3B, two different throat plates 33 are shown having stamped-in length scales and pass-through slots 53 for a clutch feed 34 (FIGS. 5C and 5D). The two throat plates 33 differ in the size or length of a needle pass-through opening 55 and/or of a code 57 that is printed or stamped on the upper side and/or the underside of the throat plate 33. The code 57 can for example be fashioned as a bar code, as a number, or as a color code, and is uniquely assigned to a particular type of throat plate.

In FIGS. 4A-4D, four different types of sewing feet are shown. They differ not only in their shape or design, but also by a visibly printed or stamped code 57 in the form of a number. The code "1" characterizes a back-transport foot for useful and decorative stitching, code "2" designates an overlock foot, code "9" designates a darning foot, and code "37" designates a patchwork foot.

Sewing machine elements need not necessarily be characterized with a code, if a unique identification is also possible on the basis of other features.

In FIGS. 5A and 5B, the fastening of a sewing foot 21 to the sewing foot holder 19 is shown schematically. Here, a cup-type recess 59 on the upper side of the sewing foot 21 is pushed from below over a peg 61 that protrudes downward on the sewing foot holder 19. Subsequently, the sewing foot 21 is clamped fast on the sewing foot holder 19 using a knee lever 63. If the sewing foot 21 is not seated properly on the sewing foot holder 19, this can be recognized for example by a lowered and/or oblique position of the sewing foot 21, or by a changed pivot position of the knee lever 63 in comparison with a position it should have when the sewing foot 21 is correctly fastened.

FIGS. 5C and 5D show the different positions of the sewing foot 21, or of a sewing foot sole 22 coupled to the sewing foot 21 at the bottom, for the case of a flat seating on clutch feed 34 (FIG. 5C) and during the crossing of a seam 65 of an article 67 that is being sewn.

FIGS. 6A-6I show a plurality of different types of sewing needles. They comprise differing features, such as for example needle diameter d, type of point (cutting point, rounding diameter of a ball point), number of needles 17 in the case of multiple needles, distances s between individual needles 17 of such a group, shape of the needles (e.g., round needles, sword-shaped needles). Needles 17 shown in FIGS. 6A-6I are, respectively: a sword-shaped needle 17*a*, a drilling needle 17*b*, a double needle 17*c*, a needle 17*d* having a cutting point, a needle 17*e* having a fine point, two needles 17*f* and 17*g* having medium ball points, a needle 17*h* having a fine ball point, and a universal needle 17*i* having a slightly rounded point.

In the target quantity memory 45 there may be stored, in suitable form, target quantities and/or comparative values and/or criteria for comparing measurement quantities that are acquired by the cameras 25 and prepared by the image processing unit 43.

One or more of the cameras 25 can be situated such that, in addition to at least one sewing machine element, they can also acquire sewing elements or parts thereof before, during, or after the processing by the sewing machine 1. The term "sewing elements" includes for example the article being sewn 67, threads such as the upper thread and the bobbin thread, a hem, seam, or stitching pattern on the article being sewn 67, a pattern for a hem or a stitching pattern, or the like.

Partial areas of such sewing elements are also designated as sewing elements. Sewing elements can thus be brought into the stitch formation area between the lower arm 7 and the upper arm 9 during sewing and/or embroidering and/or quilting or similar processes, and can be processed or acquired there.

In the target quantity memory 45, as target quantities or comparison quantities there can be stored information concerning sewing machine elements, or individual features of such sewing machine elements, such as their situation, size, color, shape, and position, e.g. in relation to the sewing machine 1 or in relation to other sewing machine elements. Thus, for example concerning the sewing feet 21 an item of visual information can be stored concerning how they can be recorded by one of the cameras 25 when the sewing foot 21 is correctly fastened to the sewing foot holder 19. Alternatively, or in addition, an image of the contours or edges of a sewing foot 21 fastened in this way to the sewing foot holder 19, or of a code 57 situated on the sewing foot 21, can also be stored. Instead of, or in addition to, the items of visual information concerning correctly mounted sewing machine elements, typical images of incorrectly mounted sewing machine elements can also be stored in the target quantity memory 45. The image processing unit 43 can process the items of image information recorded by the camera or cameras 25 in accordance with the rules given in a program memory (not shown) as to whether and, if so, which, of the features stored in the target quantity memory 45 agree sufficiently with the features acquired by the camera or cameras 25, or deviate from these features. If an agreement of features can be determined, the image processing unit 43 can also check the position and orientation thereof. If the image processing unit 43 determines for example that a sewing foot 21 has the number three as code 57, but that this number three is not situated in the expected orientation and/or at the expected location in the image segment recorded by the associated camera 25, this is an indication that the sewing foot 21 is not correctly fastened to the sewing foot holder 19. An additional indication of an incorrectly mounted sewing foot 21 can be the determination that the knee lever 63 on the sewing foot holder 19 is in an open position (FIG. 5B). The image processing unit 43 can cause the machine control unit 47 to warn the user, by means of a warning tone or a warning message spoken by a synthesized voice, of the problem of an incorrectly mounted sewing foot 21. Alternatively, or in addition, a warning message can also be outputted on the display device 10, indicating the determined problem. Analogous to the determination as to whether and which sewing foot 21 is fastened to the sewing foot holder 19, and whether the fastening is free of problems, the present and correct fastening of other sewing machine elements can also be checked. In addition to, or instead of, warning messages, the machine control unit 47 can also initiate other measures. Such processes may include those described non-definitively below:

- Through comparison of the camera image with image information stored in the target quantity memory 45, the image processing unit 43 recognizes that a particular type of sewing foot is correctly placed in the sewing foot holder. This information is relayed to the machine control unit 47. Subsequently, the machine control unit 47 displays for selection on the display 10, which is fashioned as a touch screen, only sewing stitches or stitch types that are compatible with this sewing foot type.
- On the basis of data requested by the image processing unit 43, the machine control unit 47 recognizes that a double needle 17*c* has been placed in the needle holder 15, and that a throat plate 33 that is not compatible with this needle type is fastened to the lower arm 7, for example by a snap connection, screw connection, or magnetic connection. As a first measure, the machine control unit 47 prevents the main drive 51 from being able to be activated, or decouples the needle bar 13 from the main drive 51. As a further measure, a warning is outputted on the display 10 and/or the acoustic signal generator 49, as described above.
- The machine control unit 47 receives from image processing unit 43 a communication that a foreign object, such as for example a pin, a scissors, or the finger of a person, is situated in the stitch formation area under the needle 17. As described, the machine control unit 47 prevents the sewing process from starting. Of course, safety-relevant quantities can also be acquired in redundant or parallel fashion by additional acquisition means.
- The machine control unit 47 initiates the storing of data currently acquired by the image processing unit 43 in a temporary working memory (not shown) and continuously updates these data. The sequence and frequency of these updatings and/or of the acquisition of individual sewing machine elements by the image processing unit 43 can depend for example on actions of the operator such as the operation of the foot switch for starting the sewing process, on a possible risk of injury, and on the risk of damage to the sewing machine 1.
- The machine control unit 47 signals the image processing unit 43 to acquire items of information such as for example the presence, the correct mounting, or the type of various sewing machine elements.

Analogous to items of information concerning the sewing machine elements, the image processing unit 43 can also acquire, process, and store in the target quantity memory 45 items of information concerning sewing elements, their structural features, and their situation and orientation, for example in relation to the sewing machine 1 or in relation to sewing machine elements. Thus, for example, for one or more different types of material or fabric, and for particular orientations of the material given a flat seating on the lower arm 7 in the area of the throat plate 33, the typical directions of the thread orientations, the thread thickness, and/or the distance between adjacent threads and/or the number of threads per length unit in one or more directions or dimensions, and/or the color, can be stored. In addition, in the target quantity memory 45 images can be stored of the upper thread threaded in the needle 17, or of the course of the upper thread in the area of the needle 17 or in the area between the sewing machine head 11 and the throat plate 33, as well as images of the bobbin thread in the area of the hook 35.

In the following, additional sewing elements or features of such sewing elements are stated in a non-conclusive list:

- Color of threads or of seams,
- Thickness of threads or of seams,
- Thread orientation without and with broken thread,
- Brightness, color, shape, design, contour, structure, size, position, or orientation of a sewing element or of a part thereof,
- Seam appearance (in particular, the design of a seam, the thread entry and/or knotting),
- Various types of material, seated flatly,
- Embroidery pattern or images, or applications,
- Shapes or contours of the article being sewn, with correct and/or incorrect (e.g. bunched or twisted) seating.

The storing of features or target quantities of the sewing machine elements and the sewing elements can for example take place from an external data carrier via a communication interface of the sewing machine 1, the data carrier being able to be connected to the sewing machine 1 directly or via a communication network and/or via the Internet (not shown).

Alternatively, or in addition, the image processing unit 43 can be designed to acquire images of sewing elements and of sewing machine elements that are positioned correctly on the sewing machine 1, and to store them in the target quantity memory 45. For this purpose, the user activates a learning mode at one of the operating elements 12. Subsequently, the cameras 25 acquire, in immediate succession, an image of the correctly positioned sewing machine element or sewing element and an image without this element. From these images, the image processing unit determines an image of the element itself as a difference between the images. This image of the element can be stored in the target quantity memory 45 directly or after a subsequent further processing by the image processing unit 43 using known image processing methods, such as edge extraction or Fourier transformation. Information concerning the sewing machine elements that have been detached from the sewing machine 1 or are fastened correctly or incorrectly on the sewing machine 1 or on the mounting devices thereof can for example be stored in the target quantity memory 45. The target value memory 45 can also include information concerning a plurality of possible dispositions, operating positions, or orientations of sewing machine elements on the sewing machine 1.

In addition to the target quantity memory 45, the sewing machine 1 can comprise a data memory unit (not shown). This can be physically identical with the target quantity memory 45, or can alternatively be fashioned as an additional storage medium. In the data memory, images recorded by the camera or cameras 25 can be stored as needed. In this way, for example current sewing operations can be documented, or patterns can be stored. In addition, the sewing machine 1 can comprise a modem, or in general a communication interface, for the creation of communication connections via a network and/or the Internet. Images recorded by the cameras 25 of a problem situation can thus easily be communicated to a help desk, for example. In the reverse direction, images, or any information, can be loaded into the data memory via the Internet. In order to support or facilitate operational steps, such as for example the threading of a thread into the eye of the needle 17, or the precise positioning of the article being sewn 67 under the needle 17, images acquired by the camera or cameras 25 can also be displayed on an LCD and/or on the display unit 10.

The cameras 25 can be fashioned such that both the acquisition of individual images and also of rapid image sequences are possible. The image processing unit 43 can be fashioned such that, in particular, the following monitoring, auxiliary, storage, measurement, control, or regulatory functions are possible in connection with the machine control unit 47:

- monitoring of the upper thread and/or of the bobbinthread for thread breakage,
- monitoring of the advance of the material,
- recognition of stretching and/or twisting or bunching, i.e., the drawing together of the material,
- monitoring of the thread entry and/or of the knotting of the bobbin thread and upper thread,
- recognition of shifting of the position of the material during the processing of a stack having a plurality of layers of material,
- monitoring of the seam quality,
- recognition of different types of material,
- recognition of the movement of the material (magnitude, direction). This information can be used to determine the slippage, i.e., a deviation of the actual movement of the material from the desired movement. In particular, it can be used as a measurement quantity and the controlling of the material transport device.
- acquisition of the positions of individual patterns or features on the material; use of this information in order to control position during embroidery.
- acquisition or measurement of patterns (size, shape). Use of this information to influence pattern formation, for example in the creation of buttonholes,
- acquisition of the brightness or of the illumination of the article being sewn 67; use of this measurement quantity as a regulating quantity for regulating the brightness of a sewing light (not shown),
- acquisition and storing of images of the current sewing operation (archiving, documentation),
- acquisition of images for communication to a help desk (e.g., by means of a modem that is integrated in the sewing machine 1 or that can be connected thereto),
- acquisition and imaging of sewing machine elements and/or sewing elements, or parts thereof, on an LCD or on the display unit 10, e.g. as an auxiliary means during threading, or for the precise positioning of the article being sewn 67 under the needle 17 during embroidery.

With the device according to the present invention and the method according to the present invention, during operation of the sewing machine 1 safety can be increased, errors can be prevented, operation can be simplified and/or automated, and the quality can be improved.

The invention claimed is:

1. A device for acquiring and processing measurement quantities in a sewing machine (1) before, during, or after the processing of an article being sewn (67), the sewing machine (1) comprising a machine control unit (47) for controlling a needle bar drive, at least one image capturing camera (25), and an image processing unit (43) connected to the camera (25), a target quantity memory (45) being allocated to the image processing unit (43), information concerning a plurality of sewing machine elements is stored in the target quantity memory (45) as target quantities and the image processing unit is configured to compare image data captured by the at least one camera to the information concerning the plurality of sewing machine elements stored in the target quantity memory and identifies a presence and a correct mounting of two or more of the sewing machine elements.

2. The device according to claim 1, wherein the sewing machine elements are selected from the group consisting of: a sewing needle (17), a sewing foot (21), a throat plate (33), a threading device (23), a bobbin (39), a bobbin case (37), a hook (35), an accessory part or a tool.

3. The device according to claim 1, wherein information concerning at least one feature of at least one sewing element is stored in the target quantity memory (45) as a target quantity.

4. The device according to claim 1, a single one of the image capturing camera is provided, and the single image capturing camera is configured to capture the image data for the plurality of sewing machine elements.

5. The device according to claim 1, wherein the image capturing camera is movably mounted to capture the image data for the plurality of sewing machine elements.

6. The device according to claim 1, wherein a plurality of the image capturing cameras are provided to capture the image data for the plurality of sewing machine elements.

7. The device according to claim 1, further comprising an imaging optical system allocated to the camera (25) situated at least partially in an area of a sewing machine head (11), of an upper arm (9), or of a pedestal (5) of the sewing machine, in such a way that at least an area of the sewing machine element can be acquired by the camera (25), to the extent that the area is not occluded by a foreign object.

8. The device according to claim 1, wherein the camera (25) or an imaging optical system allocated to the camera (25) is situated at least partially in an area of a lower arm (7) of the sewing machine in such a way that at least an area of the plurality of the sewing machine elements can be acquired by the camera (25).

9. The device according to claim 1, wherein the image processing unit (43) is functionally connected with at least one or more of the machine control unit (47), an optical display device (10), an acoustic signal generator (49), or a needle bar drive.

10. The device according to claim 1, wherein a plurality of the image capturing cameras are provided to capture the image data for the plurality of sewing machine elements from a variety of directions.

11. A method for obtaining and storing information concerning at least one feature of a plurality of sewing machine elements using a device for acquiring and processing measurement quantities in a sewing machine (1) before, during, or after the processing of an article being sewn (67), the sewing machine (1) comprising a machine control unit (47) for controlling a needle bar drive, at least one image capturing camera (25), an image processing unit (43) connected to the camera (25), a target quantity memory (45) allocated to the image processing unit (43), information concerning the at least one feature of the plurality of sewing machine elements is stored in the target quantity memory (45) as target quantities, the method comprising: storing information concerning the at least one feature of the plurality of sewing machine elements in the target quantity memory (45) as target quantities, and determining at least one of agreements or deviations between the target quantities stored in the target quantity memory (45) and image information supplied by the camera (25) for two or more of the sewing machine elements using the image processing unit (43) in order to determine a presence and a correct mounting of two or more of the sewing machine elements.

12. The method according to claim 11, wherein information concerning the at least one feature of the plurality of sewing elements are stored in the target quantity memory (45) as a target quantities, and the image processing unit (43) determines the at least one of agreements or deviations between the target quantities stored in the target quantity memory (45) and the image information supplied by the camera (25).

13. The method according to claim 12, wherein information acquired by the camera (25) or determined by the image processing unit (43) is stored in the target quantity memory (45) or another memory.

14. The method according to claim 11, wherein a single one of the image capturing camera is provided, and the method further comprises the single image capturing camera capturing the image data for the plurality of sewing machine elements.

15. The method according to claim 11, wherein the image capturing camera is movably mounted, and the method further comprises moving the camera to capture the image data for the plurality of sewing machine elements.

16. The method according to claim 11, further comprising monitoring whether two or more of the following conditions occurs using the image processing unit (43):

a) a needle (17) is placed in a needle holder (15) on a needle bar (13) of the sewing machine,
b) the needle (17) is placed correctly in the needle holder (15),
c) the needle (17) placed in the needle holder (15) has features of a particular needle type,
d) a sewing foot (21) is situated on a sewing foot holder (19) of the sewing machine,
e) the sewing foot (21) is correctly fastened to the sewing foot holder (19),
f) the sewing foot (21) placed in the sewing foot holder (19) has features of a particular sewing foot type,
g) the sewing foot (21) is seated properly,
h) the sewing foot (21) is in a raised or lowered position,
i) a throat plate (33) is fastened to the lower arm (7) of the sewing machine,
j) the throat plate (33) is fastened correctly to the lower arm (7),
k) the throat plate (33) fastened to the lower arm (7) has features of a particular type of throat plate,
l) a threading device (23) is present,
m) the threading device (23) has features of a particular type of threading device (23),
n) the threading device (23) is in a particular operating position,
o) an accessory part or a tool is correctly situated on the sewing machine (1),
p) the accessory part or tool has features of a particular type of accessory part or type of tool,
q) a bobbin case (37) is placed correctly in a hook (35) in the lower arm (7) of the sewing machine,
r) a bobbin (39) is situated in the bobbin case (37),
s) a minimum amount of thread that can be predetermined is wound on the bobbin (39),
t) a foreign body is situated in a stitch area of the sewing needle (17),
u) at least one or more of a color, brightness, shape, design, contour, structure, size, position, orientation, or situation of a sewing machine element or of a partial area thereof corresponds to predetermined criteria,
v) at least one of a change of position or orientation of a sewing machine element or of a partial area thereof corresponds to predetermined criteria.

17. The method according to claim 11, further comprising preparing and displaying image information from the at least one camera (25) on at least one of a display device (10) or storing the image information in at least one of a data storage unit or transmitting the image information using a modem.

18. The method according to claim 11, further comprising determining two or more of the following using the image processing unit (43):

a) presence of a broken thread,
b) at least one of a color, brightness, shape, design, contour, structure, size, position, orientation, or situation of a sewing element or of a partial area thereof corresponds to predetermined criteria,
c) at least one of a change of a position or orientation of a sewing element or of a partial area thereof corresponds to predetermined criteria,
d) a seam quality corresponds to predetermined criteria,
e) an article being sewn (67) is bunched or twisted,
f) a shift in position of the material being sewn.

19. The method according to claim 11, further comprising the image processing unit (43) providing the machine control unit (47) with measurement quantities, control quantities, or regulating quantities for the sewing process.

20. A method for obtaining and storing information concerning at least one feature of at least one sewing machine element using a device for acquiring and processing measurement quantities in a sewing machine (1) before, during, or after the processing of an article being sewn (67), the sewing machine (1) comprising a machine control unit (47) for controlling a needle bar drive, and comprising at least one image capturing camera (25) having a one- or two-dimensional array of light-sensitive pixels and an image processing unit (43) connected to the camera (25), a target quantity memory (45) being allocated to the image processing unit (43), information concerning at least one feature of at least one sewing machine element is stored in the target quantity memory (45) as a target quantity, the method comprising storing information concerning the at least one feature of the at least one sewing machine element in the target quantity memory (45) as a target quantity, and determining at least one of agreements or deviations between the target quantities stored in the target quantity memory (45) and image information supplied by the camera (25) in the image processing unit (43), information concerning at least one feature of at least one sewing element is stored in the target quantity memory (45) as a target quantity, and the image processing unit (43) determines the at least one of agreements or deviations between target quantities stored in the target quantity memory (45) and the image information supplied by the camera (25), and the image processing unit (43) determines information concerning at least one of brightness or contrast from images recorded by the camera (25), and the machine control unit (47) influences one or more light sources dependent on this information.

* * * * *